US010583329B2

(12) United States Patent
Wieczorek et al.

(10) Patent No.: US 10,583,329 B2
(45) Date of Patent: Mar. 10, 2020

(54) RESCUE DEVICE WITH AN AVALANCHE AIRBAG

(71) Applicant: AEROSIZE SPÓŁKA Z OGRANICZONĄ ODPOWIEDZIALNOŚCIĄ, Szczecin (PL)

(72) Inventors: Wojciech Wieczorek, Bielsko-Biała (PL); Andrzej Wieczorek, Bielsko-Biała (PL)

(73) Assignee: AEROSIZE SPÓŁKA Z OGRANICZONĄ ODPOWIEDZIALNOŚCIĄ, Szczecin (PL)

( * ) Notice: Subject to any disclaimer, the term of this patent is extended or adjusted under 35 U.S.C. 154(b) by 0 days.

(21) Appl. No.: 15/558,530

(22) PCT Filed: Mar. 7, 2016

(86) PCT No.: PCT/PL2016/000024
§ 371 (c)(1),
(2) Date: Sep. 14, 2017

(87) PCT Pub. No.: WO2016/148592
PCT Pub. Date: Sep. 22, 2016

(65) Prior Publication Data

US 2018/0078823 A1 Mar. 22, 2018

(30) Foreign Application Priority Data

Mar. 16, 2015 (PL) ..... 411607

(51) Int. Cl.
*A63B 29/02* (2006.01)
*A62B 33/00* (2006.01)

(52) U.S. Cl.
CPC ..... *A63B 29/021* (2013.01); *A62B 33/00* (2013.01)

(58) Field of Classification Search
CPC ..... A63B 29/021; A62B 33/00; B63C 9/1055; B63C 9/1255; B63C 9/155; B63C 9/18
See application file for complete search history.

(56) References Cited

U.S. PATENT DOCUMENTS 3,768,467 A * 10/1973 Jennings ..... B63C 9/06 128/205.26
3,895,396 A 7/1975 Amarantos
(Continued)

FOREIGN PATENT DOCUMENTS

| | | |
|---|---|---|
| CH | 705341 B1 | 2/2013 |
| EP | 0723790 A2 | 7/1996 |
| FR | 2924027 | 5/2009 |

OTHER PUBLICATIONS

International Search Report (PCT/PL2016/000024, dated Jul. 28, 2016); 3 pages.

*Primary Examiner* — Ajay Vasudeva
(74) *Attorney, Agent, or Firm* — The Maxham Firm; Lawrence A. Maxham

(57) ABSTRACT

A rescue device with a hybrid foldable avalanche airbag, the airbag containing at least one outer gas compartment that surrounds at least one inner air compartment. The outer compartment constitutes a pneumatic support frame for the airbag connected via a discharge valve with at least one pressurized gas cartridge. The inner air compartment is provided with at least one check valve through which ambient air is drawn in. The folded airbag is placed in a pocket of a backpack or in a pouch provided with shoulder straps connected to a buckled belt forming thereby a vest.

5 Claims, 3 Drawing Sheets

(56) References Cited

U.S. PATENT DOCUMENTS

| | | | | | |
|---|---|---|---|---|---|
| 3,911,913 | A * | 10/1975 | June | A41D 13/018 | 128/201.29 |
| 3,984,142 | A * | 10/1976 | Van Valkenburgh | B62J 17/065 | 2/456 |
| 4,342,278 | A * | 8/1982 | Horan | B63B 7/08 | 114/345 |
| 4,907,997 | A * | 3/1990 | Hall | B63C 9/06 | 114/345 |
| 4,943,252 | A * | 7/1990 | Manix | A63B 29/021 | 441/87 |
| 6,213,429 | B1 * | 4/2001 | Chu | B64D 25/02 | 244/138 R |
| 6,270,386 | B1 * | 8/2001 | Visocekas | A41D 13/018 | 441/104 |
| 7,841,344 | B2 * | 11/2010 | Schlosser | A41D 13/018 | 128/205.22 |
| 7,878,141 | B2 | 2/2011 | Paynton et al. | | |
| 2005/0279559 | A1 | 12/2005 | Thevenot | | |
| 2009/0239428 | A1 * | 9/2009 | Berchten | A62B 33/00 | 441/80 |
| 2013/0283510 | A1 * | 10/2013 | Berchten | A62B 33/00 | 2/455 |

* cited by examiner

RESCUE DEVICE WITH AN AVALANCHE AIRBAG

FIELD OF THE INVENTION

The apparatus relates to a rescue device with a folding avalanche airbag designed to save the user's life in case of a sudden avalanche descent, preferably used as an equipment for skiers, snowboarders, mountain climbers, and trekkers.

BACKGROUND OF THE INVENTION

Patent literature describes a number of rescue devices and systems that use avalanche airbags to bring the user of such device or system to the surface of the avalanche debris. Folding airbags are preferably attached to a backpack or a harness on the user's shoulders or around the waist. The device is equipped with a pressurized gas cartridge, the gas preferably being carbon dioxide, the cartridge being connected via valves with a bag that is inflated in case of emergency.

Swiss patent CH 705341 describes a rescue device with foldable single-chamber airbag provided with an inner skeleton made of material of high tear strength. The airbag is connected via special valves of proprietary design to two cartridges filled with pressurized carbon dioxide. During an avalanche descent the airbag is automatically filled with gas and surrounds the user's neck and back.

Another solution is presented in U.S. Pat. No. 7,878,141. The device comprises a folded balloon placed in a pocket and an arrangement for inflating the balloon with a mixture of gas and ambient air. The inflating arrangement comprises a pressure gas cylinder connected via a check valve with a high-pressure tubing and an ejector to which ambient air is drawn in through an air intake. Elements of the device and the backpack are attached to a harness which comprises a panel, shoulder straps and a buckled waist belt. In case of emergency the airbag is inflated forming a single-compartment balloon that surrounds the backpack.

SUMMARY OF EMBODIMENTS OF THE INVENTION

The rescue device according to embodiments of the present invention is provided with a hybrid foldable avalanche airbag, the airbag containing at least one outer gas compartment and at least one, surrounded by the former, inner air compartment.

The outer compartment constitutes a pneumatic support frame for the airbag and it is connected via a valve with a pressurized gas cartridge. The inner air compartment is provided with at least one check valve through which ambient air is drawn in. The inner compartment has a common wall with the outer compartment.

In a preferable embodiment the hybrid avalanche airbag has the shape of an elongated balloon with the outer compartment provided with spacer elements, preferably in the form of strips, evenly arranged and connected with the walls of the compartment. The air compartment is provided with two check valves arranged opposite each other.

In another embodiment the device has a hybrid airbag in the shape of an elongated balloon with the outer compartment consisting of at least three sections evenly arranged along or across the airbag and with a common gap between them. These sections are formed by creating permanent connections of compartment walls, preferably in the form of welds. The air compartment is provided with two check valves arranged opposite each other.

In an embodiment the folded hybrid airbag is placed in a pocket of a backpack or in a pouch provided with shoulder straps connected to a buckled belt thereby forming a vest.

The rescue device with an avalanche airbag of novel hybrid design according to embodiments of the invention offers the user significant advantages and benefits by improving the safety of the user in case of an avalanche hazard and by providing higher comfort of use. The airbag consists of separate compartments the total volume of which compares with that of currently used avalanche airbags, about 150 litres, for example. Such a design of the airbag allows the use of smaller size gas cartridges, which is important for the bulk of the user's equipment and enables the use of cartridges commonly used in sailing life jackets.

This device can be used as a backpack component by placing the airbag in a pocket fastened with a hook and loop fastener, or as a self-contained vest comprising the airbag connected to shoulder straps and to a belt. A rescue device in the form of a self-contained vest is particularly suitable for those who do not want to carry a backpack, especially for those who practice extreme winter sports.

A vest is compatible with any backpack, which is an additional advantage.

BRIEF DESCRIPTION OF THE DRAWING

Exemplary embodiments of the invention are shown in the drawing, wherein.

DETAILED DESCRIPTION OF EMBODIMENTS OF THE INVENTION

Figure 1:
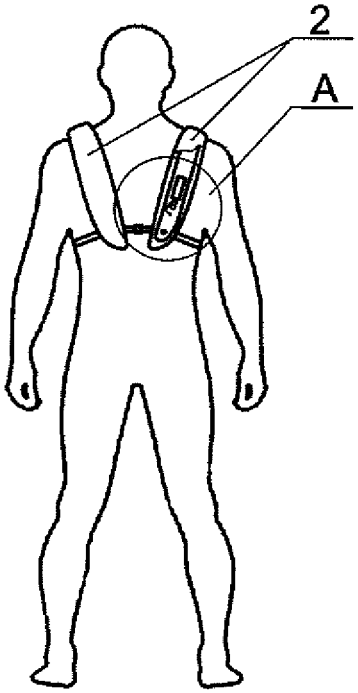
FIG. 1 shows the front view with a cut-out of the rescue device in the form of a vest with folded avalanche airbag constituting a climber's equipment.
Figure 2:
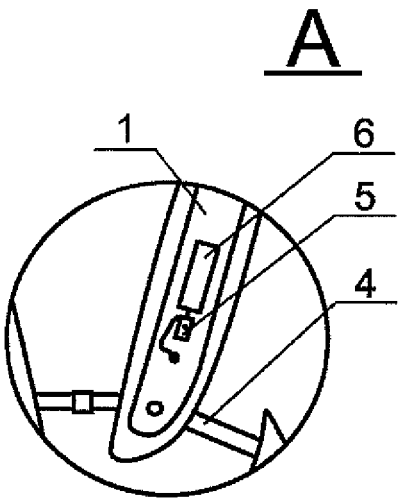
FIG. 2 shows a magnified view of a portion of the airbag in a pouch.
Figure 3:
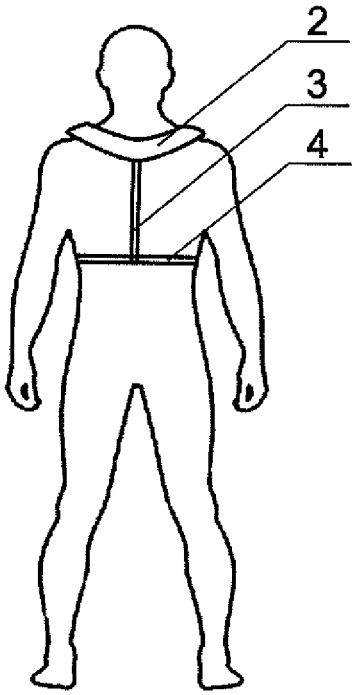
FIG. 3 shows the back view of the rescue device in the form of a vest with folded avalanche airbag constituting a climber's equipment.
Figure 4:
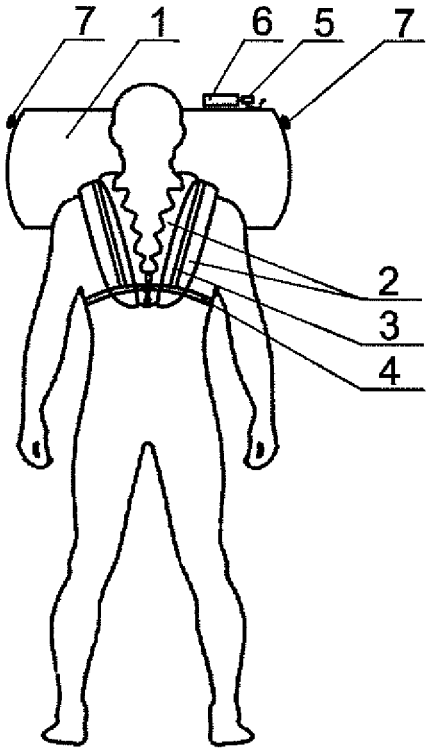
FIG. 4 shows the front view of the rescue device with inflated avalanche airbag constituting climber's equipment.
Figure 5:
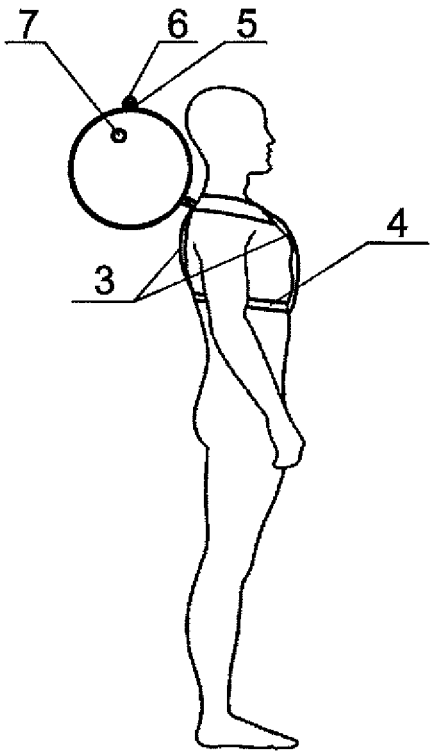
FIG. 5 shows the side view of the rescue device with inflated avalanche airbag constituting climber's equipment.

In the drawing the rescue device is presented in FIGS. 1, 2, 3, 4 and 5. The device has a folded hybrid avalanche airbag 1 (FIGS. 1, 2 and 3) placed in pouch 2 fastened with a hook and loop fastener or with a special zip fastener, the said pouch being connected to shoulder straps 3 and buckled belt 4. FIGS. 4 and 5 show the avalanche airbag 1 in an inflated state. Airbag 1 is provided with a discharge valve 5 connected to a cartridge 6, which may contain pressurized carbon dioxide, for example, and with two check valves 7.

Figure 6:
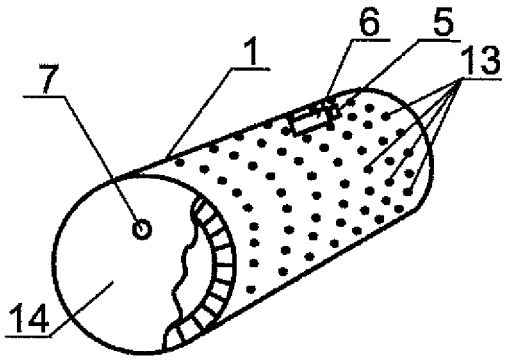
FIG. 6 shows an axonometric view with a partial cross-section of a first embodiment of the inflated avalanche airbag.
Figure 7:
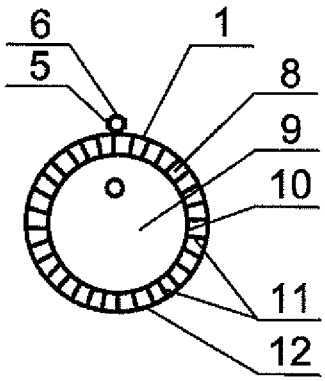
FIG. 7 shows cross-section of the embodiment of FIG. 6 of the inflated avalanche airbag.

In the first embodiment of the invention, presented in FIGS. 6 and 7, the inflated hybrid avalanche airbag 1 has the shape of an elongated balloon and comprises an outer gas compartment 8 and an inner air compartment 9. The outer compartment 8 constitutes a pneumatic support frame for airbag 1 and is connected via discharge valve 5 with cartridge 6. The inner compartment 9 has a common wall 10 with the outer compartment 8 provided with spacer elements 11 in the form of strips, evenly arranged and connected with walls 10 and 12 of compartment 8 by means of welds 13. Compartment 9 has two check valves 7 for drawing in ambient air, those valves being located opposite each other on side walls 14.

Figure 8:
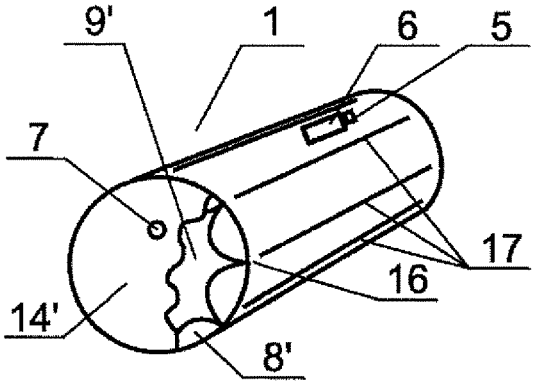
FIG. 8 shows an axonometric view with a partial cross-section of a second embodiment of the inflated avalanche airbag.
Figure 9:
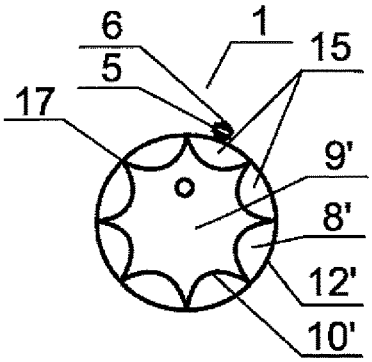
FIG. 9 shows cross-section of the embodiment of FIG. 8 of the inflated avalanche airbag.

In the second embodiment of the invention, presented in FIGS. 8 and 9, the inflated hybrid avalanche airbag 1 has the shape of an elongated balloon and comprises an outer gas compartment 8' which surrounds an inner air compartment 9'. The outer compartment 8' constitutes a pneumatic support frame for airbag 1 and is connected via discharge valve 5 with cartridge 6. The inner compartment 9' has a common wall 10' with the outer compartment 8', the latter comprising eight sections 15 evenly arranged along the airbag 1 with a common gap 16 between them. Sections 15 are formed by connecting walls 10' and 12' by means of welds 17. Compartment 9' is provided with two check valves 7 for drawing in ambient air, those valves being located opposite each other on side walls 14'.

Figure 10:
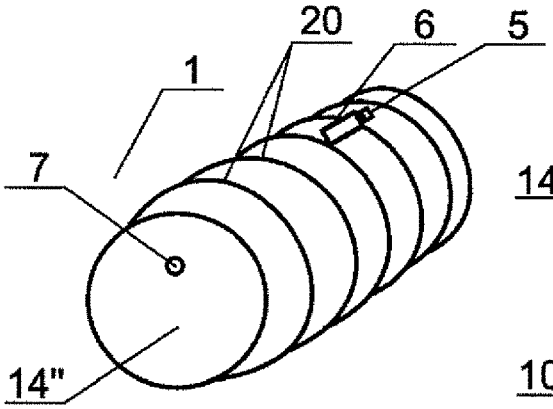
FIG. 10 shows an axonometric view of a third embodiment of the inflated avalanche airbag.
Figure 11:
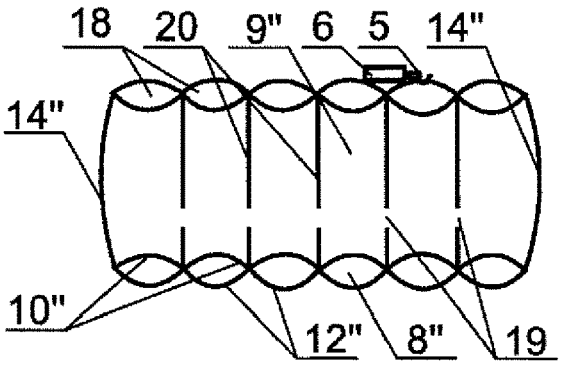
FIG. 11 shows longitudinal section of the embodiment of FIG. 10 of the inflated avalanche airbag.

In the third embodiment of the invention, presented in FIGS. 10 and 11, the inflated hybrid avalanche airbag 1 has the shape of an elongated balloon and comprises an outer gas compartment 8" which surrounds an inner air compartment 9". The outer compartment 8" constitutes a pneumatic support frame for airbag 1 and is connected via discharge valve 5 with cartridge 6. The inner compartment 9" has a common wall 10" with the outer compartment 8", the latter comprising six sections 18 evenly arranged across the airbag 1 with a common gap 19 between them. Sections 18 are formed by connecting walls 10" and 12" by means of welds 20. Compartment 9" is provided with two check valves 7 for drawing in ambient air, those valves being located opposite each other on side walls 14".

Figure 12:
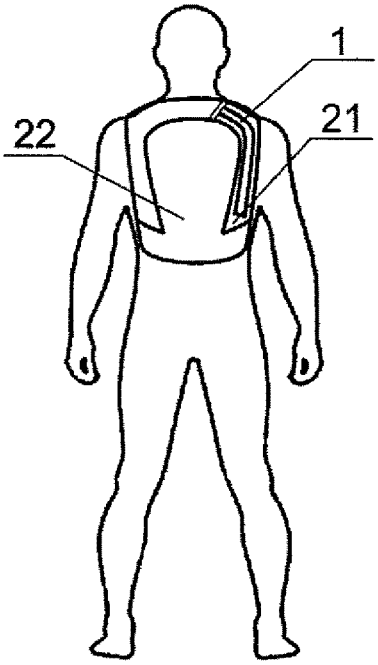
FIG. 12 shows the back view of the rescue device with folded avalanche airbag in the pocket of a backpack constituting a climber's equipment.

As shown in FIG. 12, the rescue device has a folded airbag 1 placed in pocket 21 of backpack 22.

In case of an avalanche emergency, after the discharge valve 5 is triggered, the outer compartment 8, 8', 8" is automatically filled with gas from cartridge 6. At the same time vacuum is created in inner compartment 9, 9', 9" which causes air to be drawn into that compartment through check valves 7. Due to rapid filling with gas and air of compartments 8, 8', 8" and 9, 9', 9" in airbag 1 of backpack 22 or of a vest, the person in danger is brought to the surface of the avalanche.

The invention claimed is:

1. A rescue device comprising:

a hybrid avalanche airbag having a compact folded initial state and a generally cylindrical fully expanded, inflated state, said airbag comprising:

at least one outer gas compartment defined by a unitary outer wall, said outer gas compartment constituting a pneumatic support frame for the airbag;

at least one enclosed inner air compartment, said at least one inner air compartment being unitary and being coextensive with and surrounded by said at least one outer gas compartment, said at least one inner air compartment being in fixed relationship with said at least one outer gas compartment, there being a common wall between said inner air compartment and said outer gas compartment;

at least one pressurized gas cartridge;

a triggerable discharge valve connecting said pressurized gas cartridge with said at least one outer gas compartment, pressurized gas from said at least one pressurized gas cartridge being connectable to said outer gas compartment to expand said outer gas compartment when said discharge valve is triggered, thereby creating a vacuum within said inner air compartment; and at least one check valve through which ambient air enters said at least one inner air compartment upon expansion of said outer gas compartment.

2. The rescue device according to claim 1, wherein said at least one check valve comprises two check valves arranged opposite each other.

3. The rescue device according to claim 1, wherein said airbag has the shape of an elongated balloon and said airbag further comprises:

said at least one outer gas compartment being formed with said unitary outer wall and an inner wall, said inner wall being said common wall; and spacer elements evenly arranged between and connected by welds to said outer wall and said inner wall.

4. The rescue device according to claim 1, when said airbag has the shape of an elongated balloon with said at least one outer gas compartment comprising a plurality of sections evenly arranged along or across said airbag and with a common gap between them;

said at least one outer gas compartment being formed with said unitary outer wall and an inner wall, said plurality of sections being formed by permanent connections of said outer wall and said inner wall at selected locations by welds and wherein said at least one check valve comprises two cheek valves arranged opposite each other.

5. The rescue device according to claim 1, wherein the airbag is contained in a pocket of a backpack or in a pouch provided with shoulder straps connected to a buckled belt thereby forming a vest.

* * * * *